United States Patent [19]

Thorn

[11] 4,256,064

[45] Mar. 17, 1981

[54] FUEL CONSERVING ENGINE IMPROVEMENT

[76] Inventor: Joseph R. Thorn, 6152 Turnergrove Dr., Lakewood, Calif. 90713

[21] Appl. No.: 137,389

[22] Filed: Apr. 4, 1980

[51] Int. Cl.[3] ..... F02B 75/20

[52] U.S. Cl. ..... 123/59 EC; 123/572; 123/568

[58] Field of Search ..... 123/59 BM, 59 EC, 119 B, 123/119 A

[56] References Cited

U.S. PATENT DOCUMENTS

| | | | |
|---|---|---|---|
| 3,958,540 | 5/1976 | Siewert | 123/59 EC |
| 4,033,302 | 7/1977 | Jarnuszkiewicz | 123/59 BM |
| 4,171,733 | 10/1979 | Voges | 123/119 B |

*Primary Examiner*—Ronald H. Lazarus

*Attorney, Agent, or Firm*—Fulwider, Patton, Rieber, Lee & Utecht

[57] ABSTRACT

A fuel conserving engine improvement for a four-stroke cycle internal combustion engine of the type which includes at least a pair of complemental cylinders whose pistons reciprocate in unison, but on different strokes. The improvement includes a conduit providing communication between the combustion chambers of the cylinders through openings which are uncovered by the pistons at the bottom of their strokes whereby exhaust gases flow from the cylinder whose piston is completing its power stroke to the cylinder whose piston is about to begin its compression stroke. A blower operating through a check valve pulls gases from the crankcase and circulates such gases through the conduit for discharge into the crankcase when the conduit openings are uncovered after upward movement of the pistons.

8 Claims, 5 Drawing Figures

FUEL CONSERVING ENGINE IMPROVEMENT

BACKGROUND OF THE INVENTION

1. Field of the Invention

The present invention relates to increasing the compression in one cylinder commencing its compression stroke by utilizing the residual energy or pressure of the exhaust gases in a complemental cylinder.

2. Description of the Prior Art

In a four-stroke cycle internal combustion engine, the cycle consists of a suction or intake stroke which draws air or a mixture of fuel and air into the cylinder, depending upon whether the fuel is drawn in through a carburetor or is injected. The drawing in of the fuel/air mixture develops a vacuum which typically amounts to 21 inches.

The cycle also includes a compression stroke during which the mixture of air and fuel is compressed within a combustion chamber which gradually reduces in size; and a power stroke following ignition of the charge, the pressure in the cylinder on completion of the power stroke typically being in excess of approximately 45 psi. The final stroke of the cycle is the exhaust stroke which expels the burned charge from the cylinder. Since four piston strokes are required to complete a cycle, there is one power stroke for each two revolutions of the crankshaft and, in engines having an even number of cylinders, the cylinders are arranged in complemental pairs. For each pair, ignition occurs alternately at intervals of 360 degrees of crankshaft rotation, with the pistons of the cylinders thus reciprocating in unison in the same direction, but on different strokes.

It is known to interconnect a complemental pair of cylinders whose pistons are reciprocating in unison in the same direction but on different strokes, as disclosed in U.S. Pat. No. 4,033,302, issued July 5, 1977. However, the system of that patent was designed to provide fuel injection. The interconnecting conduit was connected to a source of fuel and the higher pressure existing in a cylinder on its power stroke was utilized to inject fuel through the conduit into a complemental cylinder beginning its compression stroke.

Interconnection of a pair of complemental cylinders is also disclosed in U.S. Pat. No. 3,974,804, issued Aug. 17, 1976. In that case, interconnection was for the purpose of utilizing the residual energy of the exhaust gas of one cylinder to supercharge the other cylinder. However, scavenging of the connecting conduit was proposed to be accomplished by providing integral passageways in the pistons. Scavenging air from a blower was applied to the passageway in one piston for passage through the connecting conduit, and for discharge through the passageway in the complemental piston. The system thus required specially formed pistons and no suggestion was made respecting prevention of what would appear to be relatively high rates of air flow past the piston skirts and into the crankcase.

Thus, there appears to be no teaching in the prior art of a system for utilizing, without radically modifying the structure of the pistons, the residual energy of exhaust gases in one cylinder to supercharge a complemental cylinder whose piston is reciprocating in unison with the first cylinder, but on a different stroke, thereby to improve compression and consequently engine fuel economy.

SUMMARY OF THE INVENTION

According to the present invention, a fuel conserving engine improvement is provided for a four-stroke cycle internal combustion engine which includes at least a pair of complemental first and second cylinders having pistons which reciprocate in unison in the same direction, but on different strokes.

The invention includes conduit means which extend between the pair of complemental cylinders through openings uncovered by the pistons at the bottom of their intake and power strokes, respectively, allowing higher pressure exhaust gases from one cylinder to flow into the other cylinder. Blower means are provided to draw crankcase gases from a crankcase gas collection area for discharge into the conduit means. This provides a positive pressure which prevents lubricating oil and exhaust gases from collecting in the conduit means when the conduit openings in the cylinders are uncovered by the pistons during their upward movement. The blower means includes a check valve to prevent reverse flow of exhaust gases from the conduit means to the blower of the blower means when the pistons are at the bottom of their strokes.

The foregoing arrangement allows the higher pressures of the cylinder completing its power stroke to flow through the conduit means to the complemental cylinder which is about to commence its compression stroke, thereby changing the pressure in the latter cylinder from a negative pressure to a significantly higher pressure, and thus producing a higher pressure in the cylinder on completion of its compression stroke. Significant savings in fuel are achieved by the system, largely due to such improved compression.

Various modifications and changes may be made with regard to the foregoing detailed description without departing from the spirit of the invention.

DESCRIPTION OF THE PREFERRED EMBODIMENTS

Figure 1:
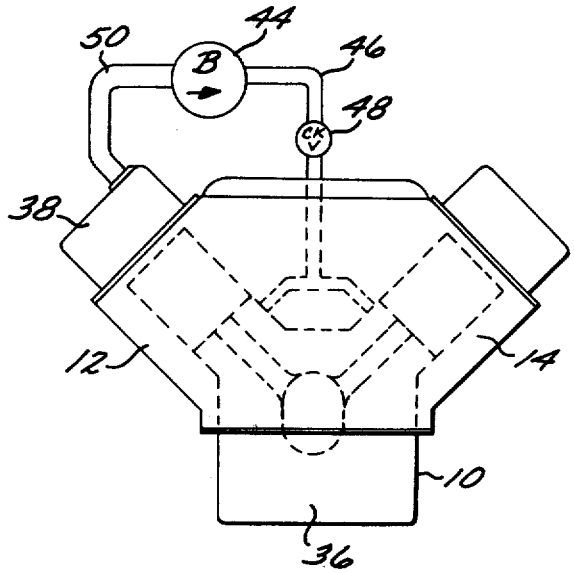
FIG. 1 is a partially diagrammatic front elevational view of a four-stroke cycle internal combustion engine.
Figure 4:
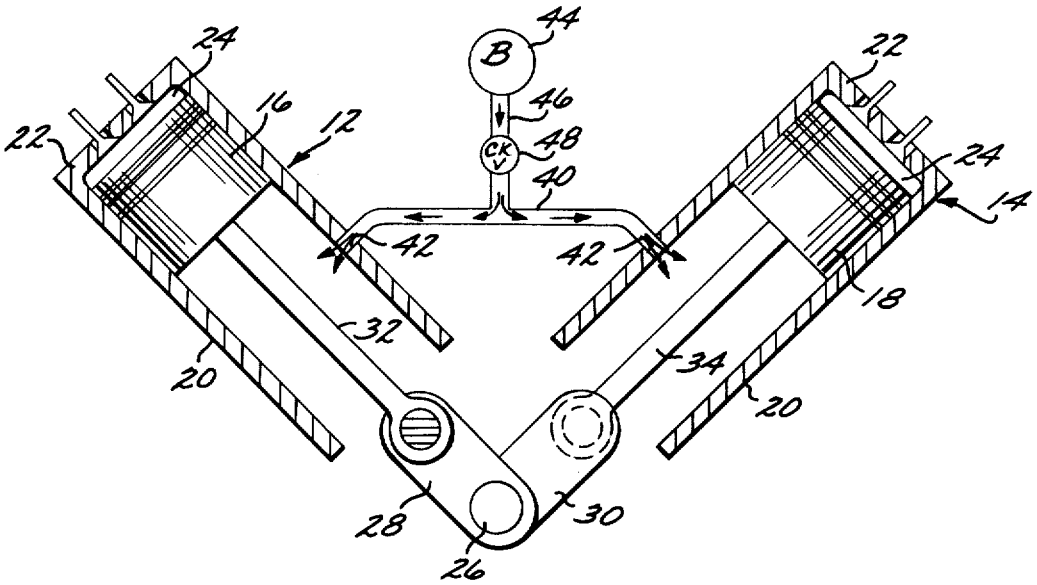
FIG. 4 is a partially schematic transverse cross-sectional view of the engine and fuel conserving engine improvement of FIG. 1, illustrating the pair of complemental pistons upon completion of their compression and exhaust strokes, respectively.
Figure 5:
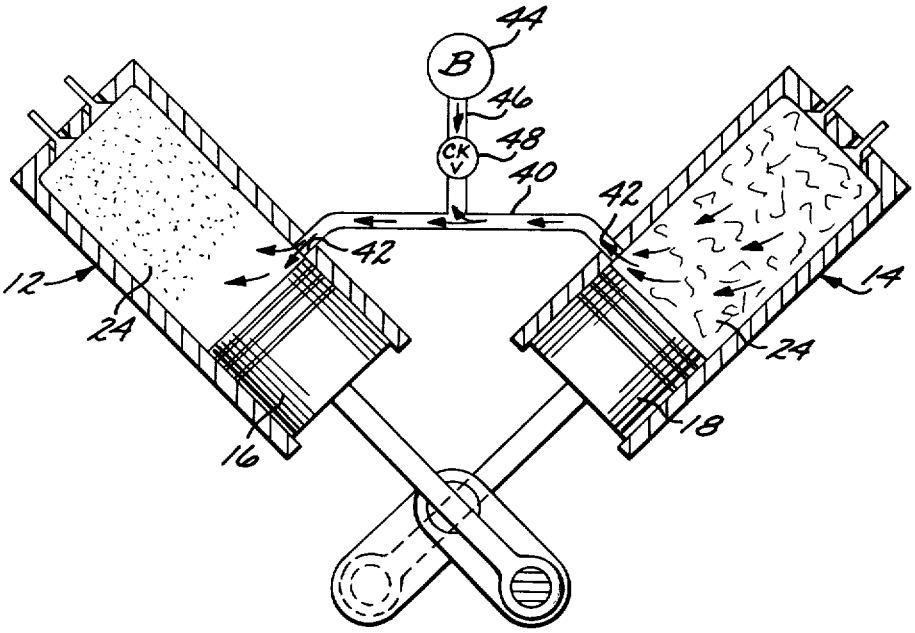
FIG. 5 is a view substantially identical to FIG. 4, but illustrating the cylinders upon completion of their intake and power strokes, respectively.

Referring now to the drawings, and particularly FIGS. 1, 4 and 5, there is illustrated a four-stroke cycle internal combustion engine 10 having an even number of complemental cylinders, only cylinders 12 and 14 being illustrated for simplicity. Although the invention is described in connection with an Otto cycle engine, it is also adapted for use with Diesel engines. Likewise, it is adapted for use with engines having carburetors or the like, or with engines provided with fuel injection.

In a four-stroke cycle engine, the complemental cylinders 12 and 14 are characterized by pistons 16 and 18 which reciprocate in unison in the same direction on different strokes. That is, when the piston 16 is moving upwardly on its compression stroke, as illustrated in FIG. 4, the piston 18 is moving in the same relative direction, but on its exhaust stroke. This is because ignition takes place in alternation at intervals of 360° of crankcase revolution.

The cylinders 12 and 14 are each characterized by a cylindrical wall 20 and a cylinder head 22 which, together with the upper surface of the associated piston 16 or 18, define a working space or combustion chamber 24 into which fuel is drawn or injected, depending upon whether the engine is of a carburetion or fuel injection type.

Exhaust or spent gases are forced out of each cylinder upon upward movement of its piston through an exhaust stroke, the gases exiting through a usual exhaust valve or the like, as will be apparent to those skilled in the art.

The associated engine components, such as the crankshaft 26, crank throws 28 and 30, and associated piston rods 32 and 34 are of conventional construction and are only generally illustrated for schematically indicating a typical arrangement of the usual engine components.

The engine 10 is characterized by an interior space or crankcase 36 adjacent the crankshaft 26, as seen in FIG. 1 within which is located lubricating oil for the engine. Gases from the crankcase 36 rise and collect within spaces inside the upper portion of the engine, such as the rocker arm cover or crankcase gas collection area 38 shown in FIG. 1. The particular location and character of the area 38 within which such crankcase gases collect is not important to the present invention and the term "crankcase gas collection area" is used in a general sense to denote any area in the engine within which the crankcase gases are collected for recirculation to the crankcase 36, intake manifold (not shown) or the like by usual smog control equipment.

According to the present invention, a conduit means is provided which includes a conduit 40 in communication with the interior of the cylinders 12 and 14 by means of openings 42 provided in the respective cylinder walls 20.

As best seen in FIG. 5, the openings 42 are uncovered by the pistons 16 and 18 at the bottom of their intake and power strokes, respectively, whereby exhaust gases in the combustion chamber 24 above the piston 18 are enabled to flow through the conduit 40 and into the combustion chamber 24 above the piston 16. Typically, the pressure in the cylinder 14 at the end of its power stroke is somewhat above 45 psi, while the pressure in the cylinder 12 at the end of its intake stroke is approximately 21 inches of vacuum.

The positive pressure in the cylinder 14 supercharges the cylinder 12 so that the pressure in the cylinder 12 just before it begins its compression stroke is significantly higher. Thus, by virtue of the present arrangement, the cylinder 12 begins its compression stroke at a higher pressure than the 21 inches of vacuum that would otherwise exist.

Once the pistons 16 and 18 move downwardly beyond the openings 42, the openings 42 are in communication with the crankcase 36. In the absence of any means for keeping clear or scavenging the openings 42 and the conduit 40, lubricating oil and exhaust gases would tend to collect on them. Oil is constantly scraped toward the openings 42 by the reciprocating action of the pistons. Without any means to keep oil out of the conduit 40, such oil would be forced into the combustion space of one of the cylinders when the pair of pistons approached the bottom of their intake and power strokes, respectively, and a smokey, smoggy exhaust and attendant high oil consumption would result.

To prevent this, a blower means is provided which includes a blower 44 in fluid communication with the conduit 40 by means of a connecting conduit 46 which includes a check valve 48. Operation of the blower 44 at a relatively low pressure, such as four psi, develops a positive pressure in the conduit 40 sufficient to flush out or scavenge the conduit 40 of any collections of exhaust gases and lubricating oil. Such gases and oil pass into the crankcase 36 each time the skirts of the pistons 16 and 18 clear the openings 42 during their upward travel. The check valve 48 prevents passage of exhaust gases and oil into the blower 44 when the pistons 16 and 18 are in the lower positions illustrated in FIG. 5.

The intake side of the blower 44 is connected to the crankcase gas collection area 38 by means of a conduit 50, as seen in FIG. 1, whereby the gases are continually recirculated through the crankcase. In the absence of such communication with the collection area 38, the blower 44 would otherwise develop excessive pressures in the crankcase 36 which would force fumes and crankcase gases through crankcase breather openings, breather pipes and the like or, in the case of modern engines which are sealed for smog control, the excess pressure could become great enough to damage the smog control system.

A conduit 40 having an inside diameter of approximately ⅛ of an inch has provided satisfactory results, although larger diameters would be equally or even more effective.

Through use of the present invention, the fuel economy of an automobile equipped with a 230 horsepower Chevrolet six-cylinder engine has been increased from approximately 15 miles per gallon to approximately 25 miles per gallon, the blower 44 being driven off the usual automobile air conditioning system.

Figure 2:
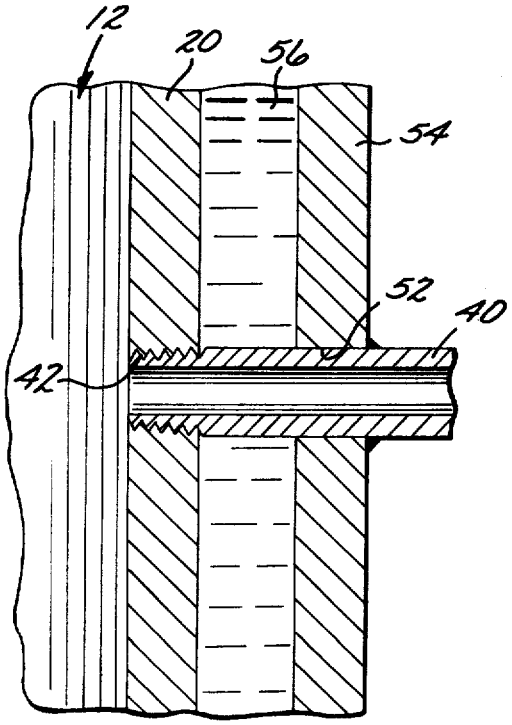
FIG. 2 is an enlarged partial transverse cross-sectional view of the area adjacent one of the cylinder walls, and particularly illustrating one method of mounting the end of a conduit in fluid communication with the interior of the cylinder.

FIG. 2 illustrates one method of installing the conduit 40 through openings 42 in the cylinders. As seen, the inner end of the conduit 40 is threadably disposed through a threaded opening provided in the cylinder wall 20 of the cylinder 12, the conduit 40 passing through a suitable opening 52 provided in an engine wall 54 provided in spaced relation to the wall 20 to define an intervening coolant space 56, as is well known to those skilled in the art. The outer extremity of the conduit 40 is welded or otherwise connected in sealing relation to the outside of the wall 54 to prevent coolant leakage. This method of installing the conduit 40 enables the invention to be fitted to already manufactured conventional engines. However, care must be exercised in the drilling, tapping and welding operations to avoid damage to the engine.

Figure 3:
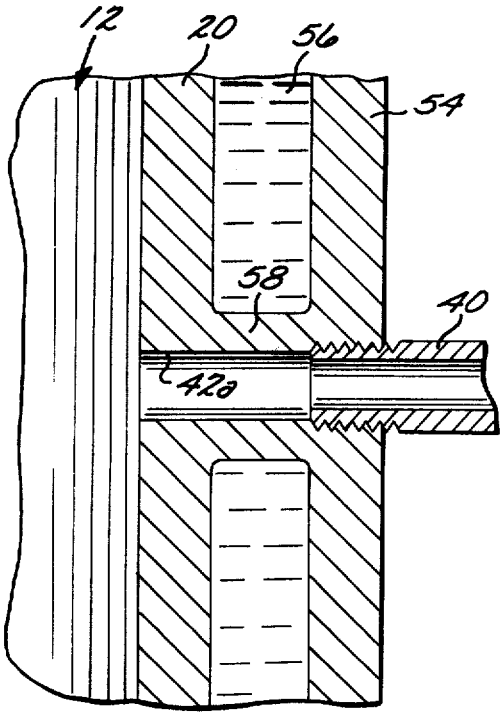
FIG. 3 is a view substantially identical to FIG. 2, but illustrating a modified arrangement for providing fluid communication between the cylinder and the conduit.

FIG. 3 illustrates another method of installing the conduit 40. In this embodiment, the engine is initially fabricated to integrally include not only the walls 20 and 54, but also an interconnecting core or section 58. The section 58 provides an area through which an opening **42*a* can easily be drilled, the outer end of the opening 42*a* being threaded to receive the conduit 40. This arrangement contemplates a slight modification of the structure of the engine block during the manufacture, but it greatly simplifies the provision of an opening 42a and the connection of the conduit 40 without any possibility of leakage of coolant from the space 56 into either the cylinder 12 or through the wall 54**.

It is contemplated that an additional increase in pressure in the cylinder commencing its compression stroke, that is, the cylinder 12 of FIG. 5, can be provided, if desired, by altering the valve timing. Thus, for example, the usual camshaft (not shown) can be altered to delay the opening of the exhaust valve of cylinder 14, and to close the intake valve of cylinder 12 sooner. Such an alteration, preferably coupled with employment of a larger inner diameter conduit 40, would result in the exhaust gases of cylinder 14 being applied to the conduit 40 for a longer period of time before the exhaust valve of cylinder 14 opens to allow exhaust gases to leave the cylinder 14 on commencement of its exhaust stroke. In similar fashion, the earlier closing of the intake valve for the cylinder 12 permits a greater build-up in pressure in that cylinder, from the gases flowing into it from the conduit 40, without having those gases escape through the intake valve. Of course, the intake and exhaust valve timing of the other cylinders would be correspondingly modified, as will be apparent, the discussion of cylinders 12 and 14 in the operating conditions illustrated in FIG. 5 merely being exemplary.

Provision of the conduit 40 to interconnect a pair of complemental cylinders, and thereby utilize the higher exhaust pressures in one cylinder to augment the initial pressure of the other cylinder on its intake stroke, has significantly improved fuel economy of the engine, and provision of a blower taking its suction from a crankcase collection area further has eliminated any tendency for lubricating oil and crankcase gases to foul the conduit openings.

Various modifications and changes may be made with regard to the foregoing detailed description without departing from the spirit of the invention.

I claim:

1. In a four-stroke cycle internal combustion engine including at least a pair of complemental first and second cylinders within which first and second pistons, respectively, reciprocate in unison in the same direction on different strokes, and further including means defining a crankcase gas collection area in communication with a crankcase adjacent said first and second cylinders, the fuel conserving engine improvement comprising:

conduit means providing fluid communication between said first and second cylinders through openings uncovered by said first and second pistons at the bottom of their intake and power strokes, respectively, whereby exhaust gases in said second cylinder can flow into said first cylinder; and blower means in fluid communication with said crankcase gas collection area and including a blower operative to discharge crankcase gases downstream into said conduit means whereby any lubricating oil and exhaust gases tending to collect in said conduit means are circulated toward said crankcase upon uncovering of said openings subsequent upward movement of said first and second pistons on their compression and exhaust strokes, respectively, said blower means including check valve means preventing upstream gas flow from said conduit means to said blower.

2. In a four-stroke cycle internal combustion engine including at least a pair of complemental first and second cylinders within which first and second pistons, respectively, reciprocate in unison in the same direction on different strokes, and further including means defining a crankcase gas collection area, the fuel conserving engine improvement comprising:

an elongated conduit opening at its opposite extremeties into said first and second cylinders through openings uncovered by the upper portions of said first and second pistons at the bottom of their intake and power strokes, respectively, whereby exhaust gases in said second cylinder can flow through said conduit and into said first cylinder; and a blower coupled to said crankcase gas collection area and to said conduit and operative to draw gases from said crankcase gas collection area and discharge said gases into said conduit whereby any lubricating oil and exhaust gases tending to collect in said conduit are discharged below the lower portion of said first and second pistons upon uncovering of said openings subsequent upward movement of said first and second pistons on their compression and exhaust strokes, respectively, said blower including check valve means preventing exhaust gas flow from flowing to said blower when said first and second pistons are at the bottom of their intake and power strokes, respectively.

3. A fuel conserving engine improvement according to claim 2 wherein said engine is characterized by wall means spaced from said first and second cylinders to define a coolant space, and wherein the opposite extremities of said conduit extend in liquid sealing relation through said wall means, across the intervening coolant spaces and within said openings in said first and second cylinders, respectively.

4. A fuel conserving engine improvement according to claim 3 wherein said opposite extremities are threadably disposed within said openings in said first and second cylinders, respectively.

5. A fuel conserving engine improvement according to claim 3 wherein said opposite extremities are disposed in welded relation through said wall means.

6. A fuel conserving engine improvement according to claim 2 wherein said engine is characterized by wall means spaced from said first and second cylinders to define a coolant space, and including engine block sections having passages therethrough and interposed between said wall means and said first and second cylinders, adjacent said openings in said first and second cylinders, respectively, whereby said passages constitute constructions of said openings, respectively, and said opposite extremities of said conduit are connected to said passages, respectively.

7. A fuel conserving engine improvement according to claim 6 wherein said engine block sections are made integral with said first and second cylinders and said wall means.

8. A fuel conserving engine improvement according to claim 6 wherein said opposite extremities are threadably disposed within said passages, respectively.

* * * * *